US006082946A

United States Patent [19]

Jensen

[11] Patent Number: 6,082,946

[45] Date of Patent: Jul. 4, 2000

[54] APPARATUS FOR REMOVING ARTICLES FROM A LAUNDRY PILE

[75] Inventor: Jørn Munch Jensen, Bern, Switzerland

[73] Assignee: Ejnar Jensen & Son A/S, Ronne, Denmark

[21] Appl. No.: 09/051,330

[22] PCT Filed: Oct. 11, 1996

[86] PCT No.: PCT/DK96/00433

§ 371 Date: Apr. 8, 1998

§ 102(e) Date: Apr. 8, 1998

[87] PCT Pub. No.: WO97/13914

PCT Pub. Date: Apr. 17, 1997

[30] Foreign Application Priority Data

Oct. 11, 1995 [DK] Denmark ..... 1144/95

[51] Int. Cl.[7] ..... B65G 47/12

[52] U.S. Cl. ..... 414/13; 414/618

[58] Field of Search ..... 414/13, 589, 609, 414/618, 729, 742; 38/7

[56] References Cited

U.S. PATENT DOCUMENTS

| | | | |
|---|---|---|---|
| 3,092,263 | 6/1963 | Beaudry et al. | 414/13 |
| 3,696,942 | 10/1972 | Kitchener et al. | 414/13 |
| 4,036,365 | 7/1977 | Rosenfeld | 209/73 |
| 4,496,277 | 1/1985 | Jungman | 414/589 |
| 4,943,198 | 7/1990 | McCabe | 414/13 |
| 5,458,454 | 10/1995 | Sorokan | 414/729 X |

FOREIGN PATENT DOCUMENTS

| | | | |
|---|---|---|---|
| 5229651 | 9/1993 | Japan | 414/618 |
| 97448 | 1/1961 | Norway | 414/13 |
| 466 705 | 3/1992 | Sweden . | |

*Primary Examiner*—James W. Keenan
*Attorney, Agent, or Firm*—Finnegan, Henderson, Farabow, Garrett & Dunner, L.L.P.

[57] ABSTRACT

An apparatus for taking out laundry articles from a laundry pile by a pull gripper which is arranged for seizing one or more laundry articles in the laundry pile, and a lifting mechanism arranged for lifting the pull gripper and the minor batch of laundry articles clear above the pile. The lifting mechanism is arranged for conveying the pull gripper and the laundry articles to a position above a support, and the pull gripper is arranged for releasing the laundry articles above the support whereby the laundry articles are deposited on the support. The laundry articles are loosened from each other which facilitates the separation of the individual laundry articles from the pile. According to the invention the pull gripper is moved by the lifting mechanism as a restricted, guided movement by a combined vertical and horizontal movement whereby a more efficient loosening of the laundry articles is obtained as well as a higher degree of repetitive accuracy.

6 Claims, 5 Drawing Sheets

APPARATUS FOR REMOVING ARTICLES FROM A LAUNDRY PILE

BACKGROUND OF THE INVENTION

1. Field of the Invention

The present invention relates to a method and an apparatus for taking out laundry articles from a laundry pile, wherein a minor batch of laundry articles is seized by a pull gripper intended therefor and pulled out of the laundry pile and lifted clear above the same.

2. Description of the Related Art

Such machines are known today for use in e.g. industrial laundries where the laundry articles, such as bedclothes and cloths which are, for instance following washing and tumble drying, in a more or less entangled pile, in a damp state.

These laundry articles are subsequently to be introduced individually into machines intended e.g. for straightening, ironing and folding the laundry articles.

In the laundries, it is thus a task to separate the laundry articles from the pile in which they are following washing and tumble drying in order to allow them to be introduced in to the subsequent machines for e.g. straightening, ironing and folding.

Today this process is carried out more or less manually but efforts are made to increasingly automate the process, the work positions involved in the manual process being quite straining, and therefore machines have already been developed to carry out at least some steps of the process automatically.

Such machines are known from e.g. DE 43 30 911 which features an arrangement consisting of two separate grippers which may cooperate to take out an individual laundry article from the laundry pile and thus to convey the individual laundry article to the subsequent machinery. The grippers in the known machine are so arranged that the gripper which pulls the individual laundry article out of the laundry pile has been optimised accordingly, whereby the gripper seizes a. comparatively small corner or a comparatively small portion of the laundry article with a view to ensuring that the gripper takes out only one laundry article from the pile.

It is a problem, however, with these prior art machines that the laundry articles in the laundry pile are often very entangled as a consequence of the washing and drying processes, and that this is enough to require a powerful pull in the laundry articles in order to separate them from the pile, Which is further aggravated by the fact that frequently the laundry articles are slightly damp whereby the friction between the laundry articles is often increased. This may mean that the gripper which takes out the laundry article from the pile is incapable of performing this task in a satisfactory manner since, advantageously, the seizing force and seizing area of the gripper is as small as possible as it is desired to ensure to the highest degree possible that the laundry articles are taken out of the pile individually. If the seizing force is increased, tearing of the laundry articles may as it is desirable to have a small seizing area.

In practice this may mean that the gripper cannot take out any laundry articles whatsoever which would require interference from an operator or readjustment of the machine.

U.S. Pat. No. 4,943,198 features an apparatus for automatically taking out laundry articles from a laundry pile whereby automation of this step of the process is allowed, and whereby it is ensured to a higher degree that no operational stoppages or tearing of the laundry articles occur.

This is obtained by a smaller batch of laundry articles being pulled out of the laundry pile by a gripper intended therefor, following which this minor batch of laundry articles is taken away from the laundry pile and conveyed above a support, following which the laundry articles are deposited on the support. This minor batch of laundry articles will then be significantly less entangled than it was in the pile following e.g. washing and tumbling, thereby facilitating the subsequent taking out of individual laundry articles from this minor batch of laundry articles substantially.

The pull gripper may thereby be so designed that it seizes a large portion of the laundry articles and in a powerful manner, since there is no requirement that the gripper takes out one single laundry article at a time from the pile. When more laundry articles are taken out at a time it follows that the risk of tearing the individual laundry article is also reduced.

Since the method and apparatus according to U.S. Pat. No. 4,943,198 deal with the desire to ensure that only one single laundry article is taken out at a time, more room is left for providing such convenient pull gripper as to ensure that laundry articles are always taken out from the pile with no regard to the quantity.

SUMMARY OF THE INVENTION

In the light of this, it is the object of the present invention to provide an apparatus with a pull gripper which is arranged for seizing a number of laundry articles in a laundry pile but ensuring to a higher degree than the prior art that the individual laundry articles in the laundry pile have been disentangled effectively from each other when the laundry pile is subsequently deposited on a support, while simultaneously ensuring to a very high degree that the minor batch of laundry articles is deposited in a uniform manner on the support thereby simplifying the subsequent process of taking out one single laundry article from the minor batch.

This is obtained by the apparatus according to the invention since a restricted, guided movement of the pull gripper in a combined vertical and horizontal movement is obtained, which means that each small batch of laundry articles taken out of the laundry pile will fall in an almost identical manner onto the support and in a relatively loose pile irrespective of the number of laundry articles present in the batch of laundry articles taken out.

Preferably the laundry articles may be deposited by the pull gripper onto the support in such a manner that it falls substantially freely down onto the support, e.g. by the lifting mechanism design being such that the pull gripper is lifted so high above the support that the small batch of laundry articles is substantially clear above the support prior to being released by the pull gripper. Hereby the free fall means that in case of several laundry articles, they will disentangle thereby facilitating a subsequent taking out of one single laundry article from the minor batch of laundry articles on the support.

Moreover, the support may conveniently consist of a distribution conveyor with a direction of conveyance away from the pull gripper whereby the laundry articles are conveyed away from the support which leaves space for subsequent laundry articles on the support.

As described above, a subsequent taking out of laundry articles may now be carried out without applying much force which makes it easy for this process to be carried out manually. According to a convenient embodiment, however, the distribution conveyor is provided with a pull gripper for successively taking out individual laundry articles from the minor batch of laundry articles on the support whereby the individual laundry articles may be taken out automatically.

According to a particularly advantageous embodiment, the apparatus comprises a feed conveyor for advancing the laundry pile from an inlet end where laundry articles are delivered onto the feed conveyor and to a position below the pull gripper whereby the laundry pile is successively conveyed to a position below the pull gripper as the laundry pile is emptied as a consequence of the minor batches of laundry articles being taken out by the pull gripper. This allows the lifting mechanism for the pull gripper to be of a simple design which allows the pull gripper to seize at the same place each time.

According to a preferred embodiment of the invention the end of the distribution conveyor which faces away from the pull gripper is arranged above the inlet end of the feed conveyor. Hereby it is obtained that the laundry articles not taken away from the distribution conveyor are recycled to the feed conveyor following which they may partake in a subsequent process.

BRIEF DESCRIPTION OF THE DRAWINGS

The invention will now be described in further detail with reference to the drawings, wherein.

DETAILED DESCRIPTION OF THE PREFERRED EMBODIMENT

Figure 1:
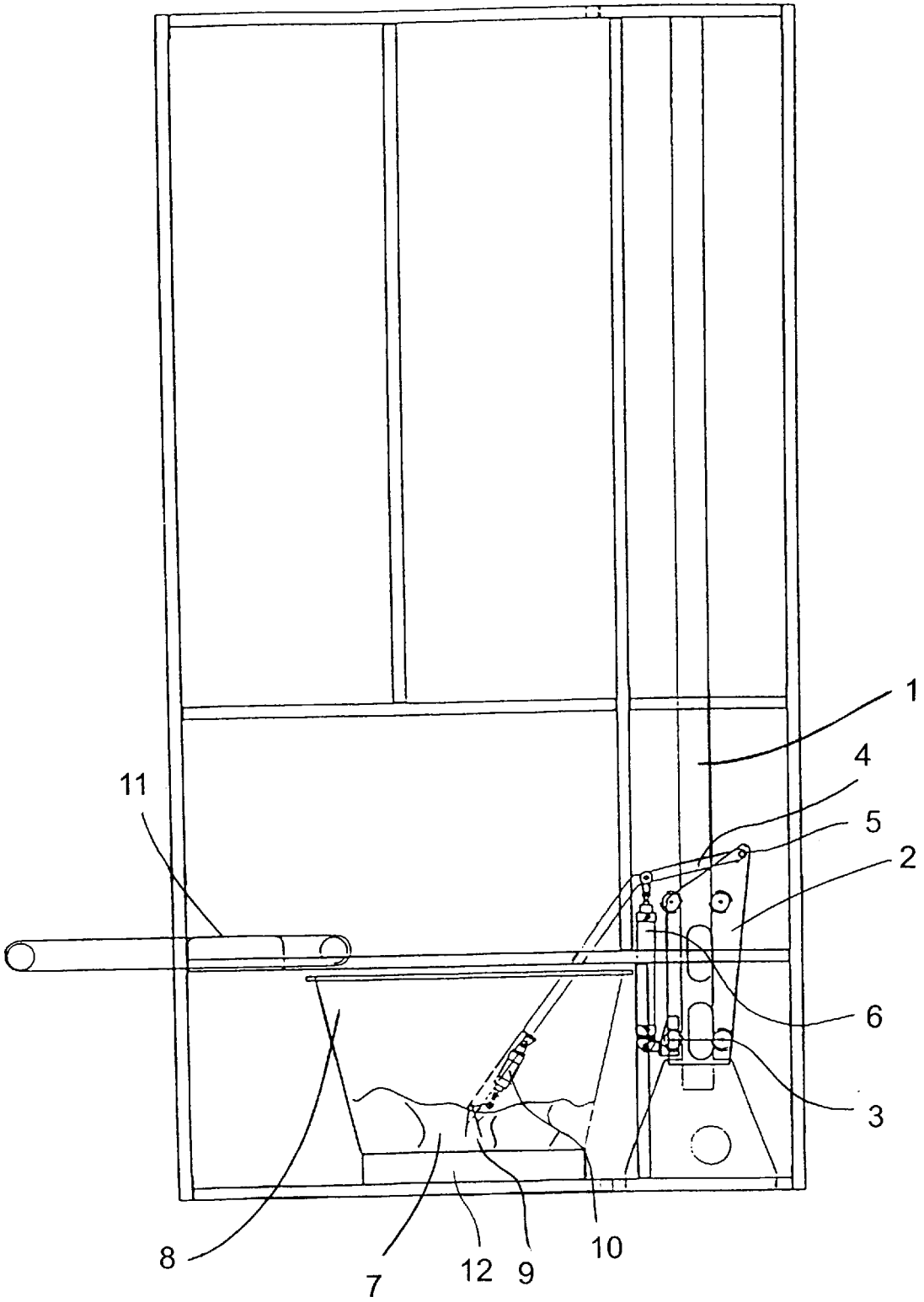
FIG. 1 is a side view outlining the principles of a apparatus according to the invention in a first working position.

Thus from FIG. 1 which outlines the principles of an apparatus according to the invention it appears that the apparatus comprises a vertical column 1 which forms a guide for a carriage 2.

The carriage 2 is provided with toothed wheels 3 which may engage with a not shown toothing along the column 1. Hereby the carriage 2 may be displaced up and down the column 1 e.g. by the toothed wheels being provided with a not shown operating device.

Moreover the carriage is provided with an arm 4 connected via a swivel 5 to the carriage 2, and an actuator is provided in the form of a pneumatic cylinder 6 the one end of which is secured to the carriage and the other end of which is secured to the arm in such a manner that the pneumatic cylinder 6 may lift and lower the arm 4 relative to the carriage 2 about the swivel 5.

At its outer end the arm 4 is provided with a gripper 9 arranged for seizing one or more laundry articles 6 in the trough 8 positioned at the bottom end of the column 1, and the gripper 9 is provided with an operating unit in the form of a pneumatic cylinder 10 with a view to opening and closing the gripper 9.

In connection with this, a conveyor in the form of a belt conveyor 11 is arranged which has a direction of conveyance away from the column 1.

Figure 2:
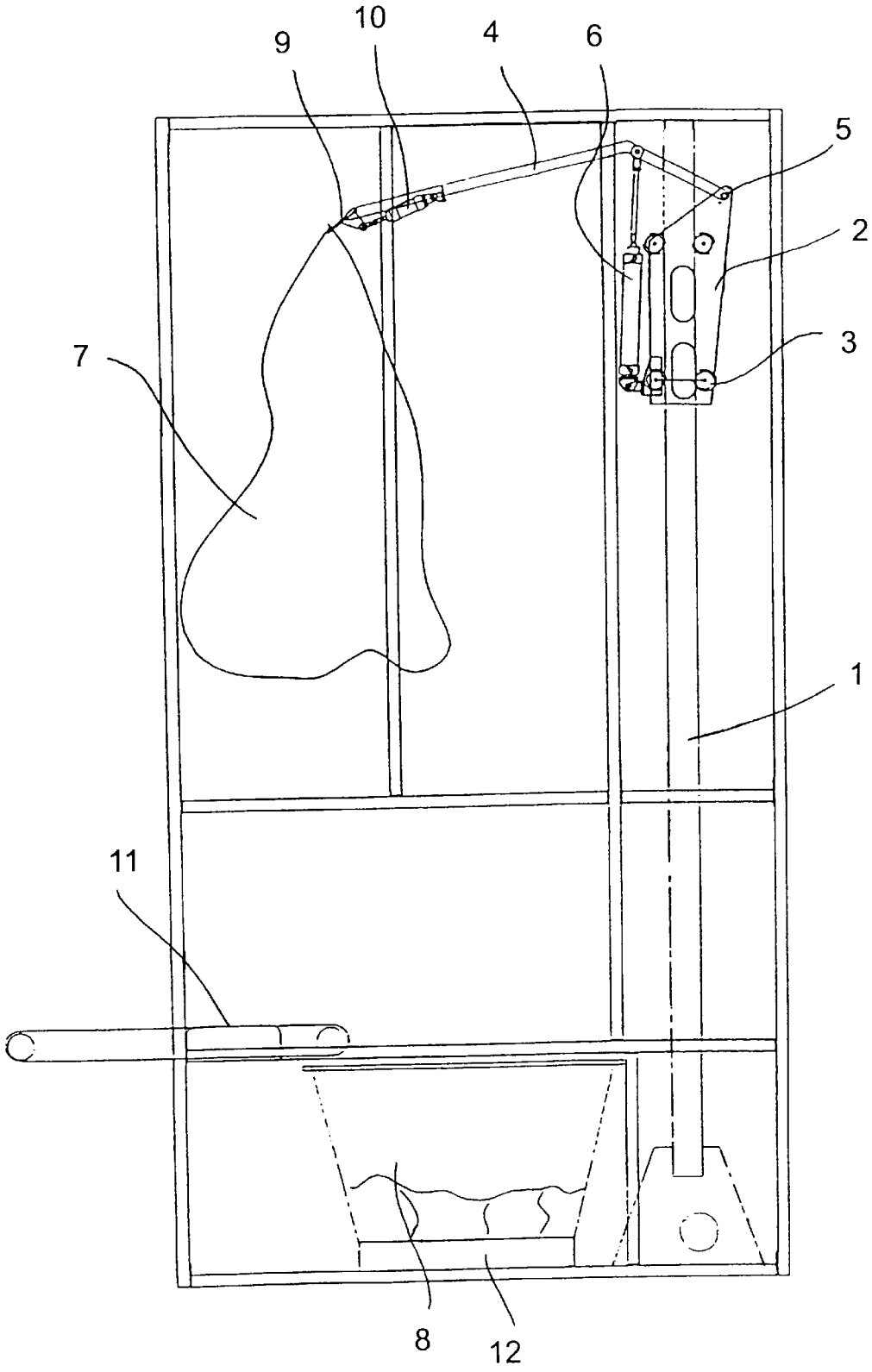
FIG. 2 outlines the principles of the apparatus according to FIG. 1 in a second working position.
Figure 3:
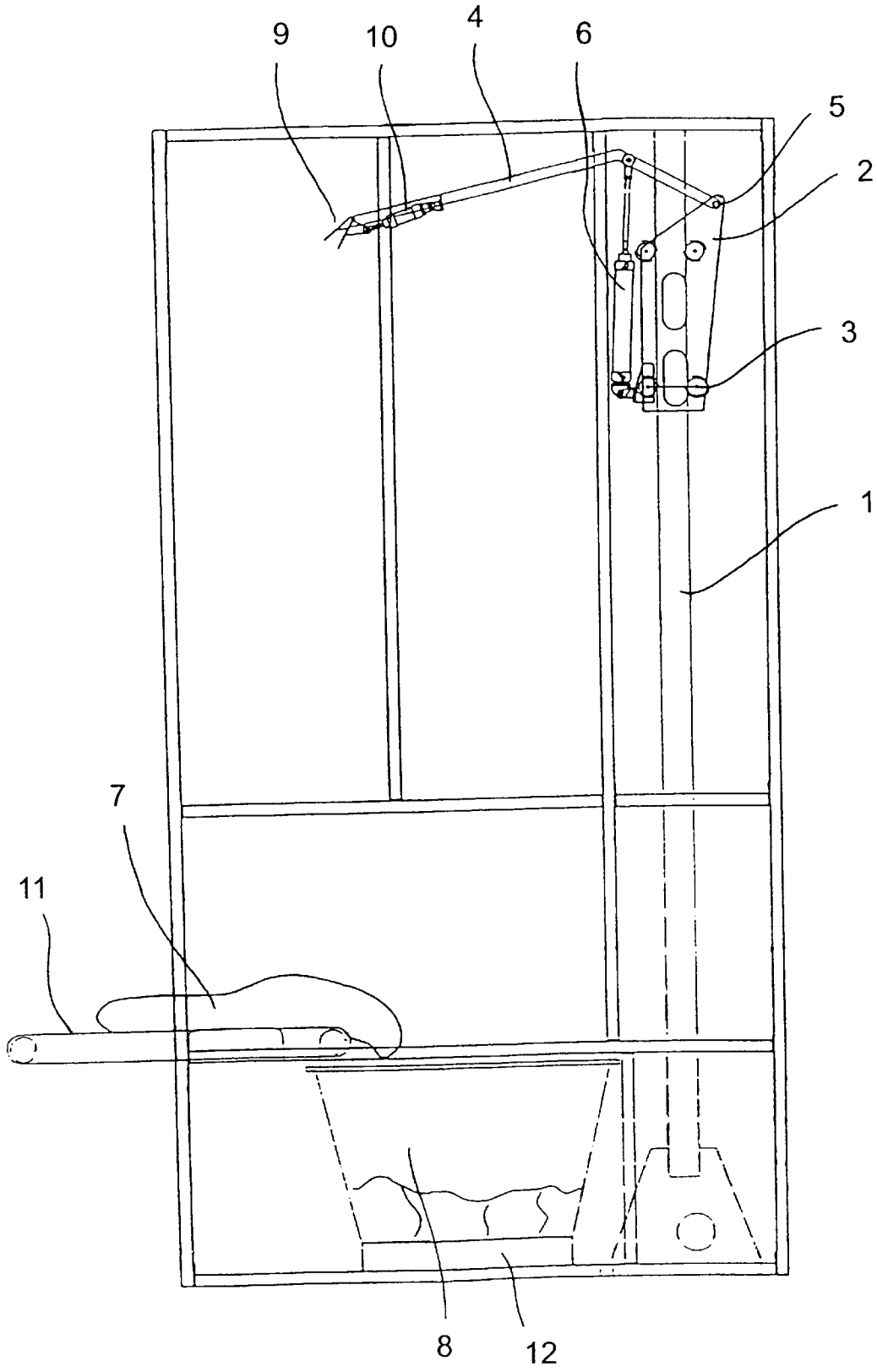
FIG. 3 outlines the principles of the apparatus according to FIGS. 1 and 2 in a third working position.

Moreover, the entire apparatus is provided with a control unit for sequential control of the individual controls in the apparatus. The construction of this control unit is not described in further detail herein as it will be obvious for the person skilled in the art to establish this on the basis of the explanation of the mode of operation of the apparatus, where FIGS. 1 through 3 illustrate different process steps according to the invention.

Thus, FIG. 1 illustrates a first process step wherein the carriage 2 is at its lowermost position on the column 1 and wherein the arm 4 along with the gripper 9 has been lowered into the trough 8 with the gripper 9 in the open state. In this position the gripper has been immersed into the laundry articles 7 and while the gripper is in this position, the gripper 9 is closed whereby it seizes one or more of the laundry articles 7.

The carriage 2 and the arm 4 are subsequently moved up to the position shown in FIG. 2 where the carriage 2 is in its top position on the column 1, and where the arm has been lifted upwards by means of the pneumatic cylinder 6 whereby the gripper 9 is caused to occupy a position above the belt conveyor 11.

Hereby one or more laundry articles 7 are pulled out of the pile in the trough 8 and are lifted so high that they are completely clear above the pile of laundry in the trough 8.

In this position which is illustrated in FIG. 2, the gripper 9 is subsequently opened whereby the laundry article or the laundry articles are caused to fall substantially freely down onto the belt conveyor 11 as shown in FIG. 3.

Hereby the laundry articles 7 are significantly loosened relative to each other and they will fall very loosely down onto the belt conveyor 11.

Finally the belt conveyor 11 conveys the laundry articles 7 away from the entire arrangement following which the individual laundry articles may be seized from the pile of laundry articles 7 on the belt conveyor 11. For the sake of clarity, the belt conveyor is herein shown to be very short and obviously it is possible in practice for the belt conveyor to have such length as is necessary to convey the laundry articles to a desired location. In this connection the belt conveyor serves as a buffer storage for laundry articles whereby periodical variations may in the operating rate of the apparatus occur without significant ensuing difficulties to the consecutive handling of the laundry articles.

This subsequent taking out of individual laundry articles may optionally be carried out manually or a subsequent pull gripper may be provided for this purpose as will be described below in connection with an alternative embodiment with reference to FIG. 5.

Figure 4:
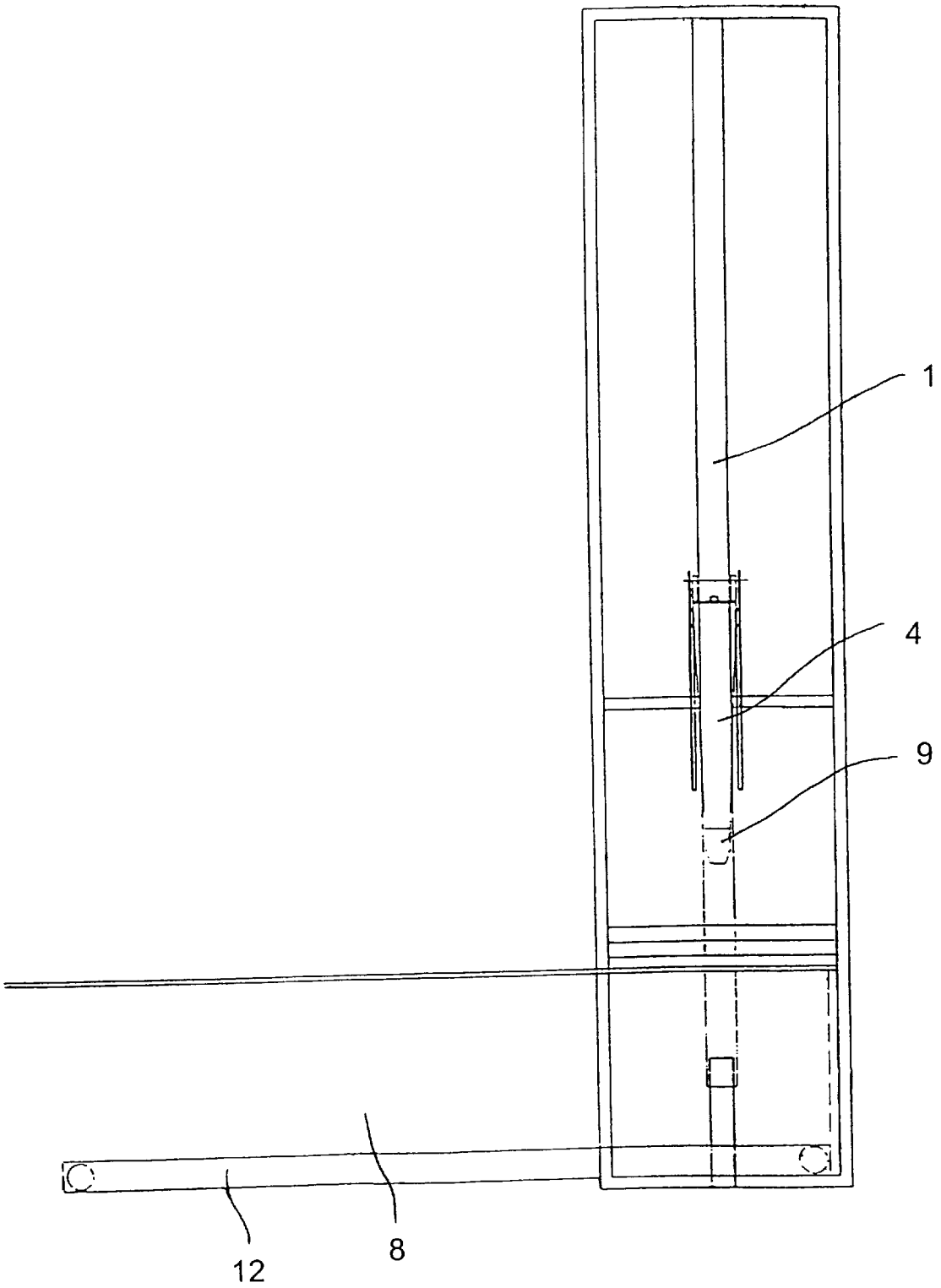
FIG. 4 is a front view of the apparatus according to FIGS. 1 through 3.

Now, FIG. 4 illustrates the apparatus according to FIGS. 1 through 3, but in a front view, from which it will appear that the bottom of the trough 8 is constituted of a belt conveyor 12 whereby the trough 8 may be filled with laundry articles at the end which is most remote from the column 1, and may subsequently convey the laundry articles to a position below the gripper 9.

Figure 5:
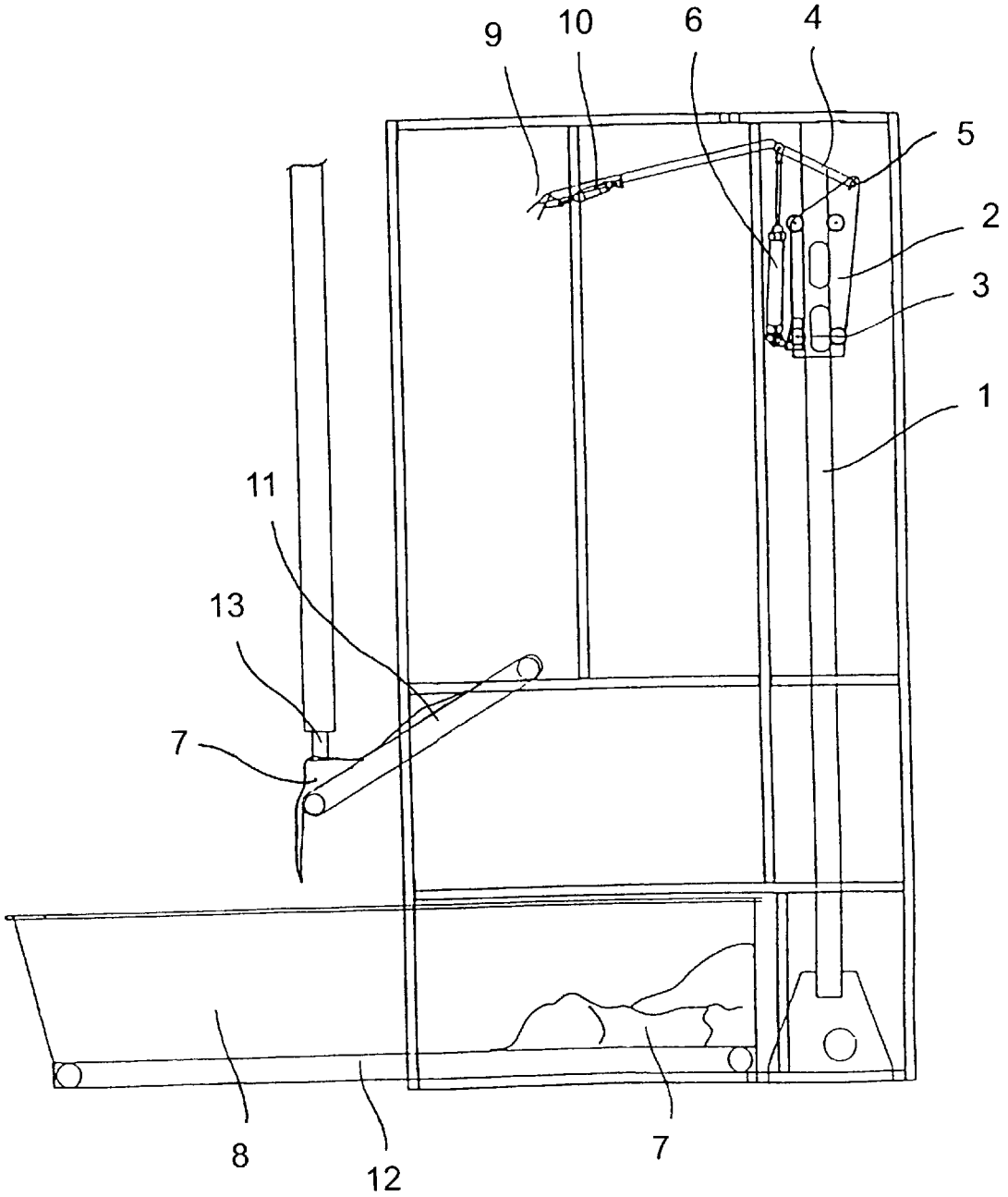
FIG. 5 is a side view outlining the principles of an alternative embodiment according to the invention.

As shown in FIG. 5, a preferred embodiment is provided with a further gripper 13 at the outlet end of the belt conveyor, said gripper 13 being arranged and optimised to successively take out individual laundry articles from the belt conveyor 11.

The individual laundry articles being loosened relative to each other on the belt conveyor allows this further gripper 13 to be designed with no regard to the fact that it has to be able to exert a powerful pull in the laundry articles in order to release them individually, and it may be optimised in order to ensure that preferably one and only one laundry article is seized.

From the embodiment outlined in FIG. 5 it will appear that the belt conveyor 11 ends above that end of the trough 8 which faces away from the column 1 whereby the those laundry articles which are for some reason or other not seized by the gripper 13 may in a simple manner be conveyed on and down into the trough 8 following which they may partake in a consecutive taking-out cycle.

Obviously, the only object of the drawings is to illustrate convenient embodiments of the invention and it will be an option to the skilled person to provide other embodiments of the invention without deviating from the basic principles of the invention. Thus the gripper 9 and the mechanism for moving the same from a position in the trough 8 and to a position above the conveyor 11 may have many different embodiments and be provided with other mechanisms than the one illustrated. Moreover, it will be obvious to the skilled person to provide different relative positionings of the components of the apparatus without the basic function of being able to deposit the laundry articles following lifting off the trough 8 being lost.

I claim:

1. An apparatus for removing laundry articles from a laundry pile, comprising a pull gripper arranged for seizing a minor batch of laundry articles in the laundry pile, and a lifting mechanism arranged for lifting the pull gripper and the minor batch of laundry articles clear above the pile, the lifting mechanism being arranged for conveying the pull gripper and the minor batch of laundry articles to a position above a support, and the pull gripper being arranged for releasing the laundry articles above the support, wherein the lifting mechanism comprises a substantially vertical guide having top and bottom portions, a carriage movable on the vertical guide between the top and bottom portions, and an arm having proximal and distal ends, the distal end carrying the pull gripper, and the proximal end being mounted on the carriage for movement of the arm between a first position in which it extends substantially horizontally from the carriage when the carriage is at the top portion of the guide, and a second position in which it is substantially downwardly inclined from the carriage when the carriage is at the bottom portion of the guide.

2. An apparatus according to claim 1, wherein the lifting mechanism is arranged in such a manner that the pull gripper is lifted sufficiently high above the support that the minor batch of laundry articles is elevated above the support prior to its release from the pull gripper.

3. An apparatus according to claims 1 or 2, wherein the support comprises a distribution conveyor having a direction of conveyance away from the pull gripper.

4. An apparatus according to claim 3, wherein another pull gripper is provided at the distribution conveyor for successively removing individual laundry articles from the minor batch of laundry articles on the support.

5. An apparatus according to claim 3 comprising a feed conveyor for advancing the laundry pile from an inlet end where laundry articles may be delivered onto the feed conveyor, the feed conveyor being arranged for conveying the laundry articles to a position below the pull gripper.

6. An apparatus according to claim 5, wherein an end of the distribution conveyor that faces away from the pull gripper is located above the inlet end of the feed conveyor.

* * * * *